United States Patent [19]

Casey

[11] Patent Number: 4,496,264

[45] Date of Patent: Jan. 29, 1985

[54] BARRIER STRUCTURE

[76] Inventor: Steven M. Casey, 102 Monroe Dr., Harleysville, Pa. 19438

[21] Appl. No.: 364,411

[22] Filed: Apr. 1, 1982

[51] Int. Cl.[3] ..... E01F 15/00

[52] U.S. Cl. ..... 404/6; 52/600; 52/677; 52/725; 256/13.1

[58] Field of Search ..... 256/13.1; 404/6; 52/303, 677, 687, 516, 600, 724, 725, 727, 728

[56] References Cited

U.S. PATENT DOCUMENTS

| | | | |
|---|---|---|---|
| 2,092,106 | 9/1937 | Coddington | 52/725 |
| 2,150,130 | 3/1939 | Ragsdale et al. | 256/13.1 |
| 2,765,158 | 6/1957 | Miles et al. . | |
| 3,092,371 | 6/1963 | Knudsen | 256/13.1 |
| 3,591,144 | 7/1971 | Lving | 404/6 |
| 3,658,300 | 4/1972 | Templeton | 256/13.1 |
| 3,678,815 | 7/1972 | Younker | 256/13.1 |
| 3,704,861 | 12/1972 | Glaeserer | 256/13.1 |
| 3,720,401 | 3/1973 | Locl | 256/19 |
| 3,780,977 | 12/1973 | Dashew | 249/15 |
| 3,980,279 | 9/1976 | Bofinger | 52/587 X |
| 3,986,735 | 9/1976 | Forrells | 256/13.1 X |
| 4,181,286 | 1/1980 | Van Doren | 249/82 |
| 4,348,133 | 9/1982 | Tsenl et al. | 256/13.1 X |

FOREIGN PATENT DOCUMENTS

| | | | |
|---|---|---|---|
| 2303133 | 10/1976 | France | 52/677 |
| 2457928 | 1/1981 | France | 404/6 |
| 1497860 | 1/1978 | United Kingdom | 256/13.1 |
| 2063973 | 6/1981 | United Kingdom | 256/13.1 |

*Primary Examiner*—William F. Pate, III
*Attorney, Agent, or Firm*—Walter B. Udell

[57] ABSTRACT

A barrier structure comprising a number of spaced apart inline vertical I-beam sections embedded in a road and having secured to the posts a number of form plates having a pair of downwardly and outwardly diverging legs and a pair of upwardly diverging extending arms, which plates have ears turned out of them used to secure the plates to the I-beams. Reinforcing rods are extended through alined apertures in a number of consecutively spaced plates, and end connected side panels are secured to tabs on the side edges of the plates and interfittingly engaged with the bottoms of the plates legs and the tops of the plates arms so that the side panels are retained in a predetermined position with respect to the upstanding plates. Concrete is poured down through the open top of the structure to completely fill the inside to the top of the side panels which act as a form for the concrete being poured, and which side panels are bonded to the concrete and remain as a permanent part of the barrier structure. A capping piece is pressed down into the concrete and interlocks with the side panels.

31 Claims, 10 Drawing Figures

BARRIER STRUCTURE

This invention relates generally to highway barriers, and more particularly relates to medial barriers and roadside guard rails of the cast concrete type.

In the past, permanent type highway medial barriers have been of many types. One type utilizes heavy and bulky steel forms which act as in-situ pouring forms for concrete. These forms are very expensive, are subject to corrosion and other damage, and require a maintenance and storage facilities when not in use. Another type of medial barrier utilizes I-beam sections set vertically into concrete foundations in the medial space between traffic lanes and to which horizontally extending steel rails are secured. This type of barrier is usually of inadequate height to prevent cars from completely or partially hurdling the barrier and into the oncoming opposing lane traffic. Moreover, this type of barrier is generally effectively destroyed by vehicle impact and must be replaced.

The barrier structure according to the invention provides the durability and safety of the poured in-situ concrete barrier without the high cost of the large numbers of expensive forms previously required, and additionally, permits much more rapid construction of concrete barriers than is possible with the use of forms, thereby substantially reducing labor costs as well.

The invention comprises a number of spaced apart inline vertical I-beam sections embedded in a road between lanes of traffic going in opposite directions, and a number of other structural elements secured to and carried by these vertical posts, which all together with poured concrete form the barrier structure. One aspect of the invention recognizes the fact that the vertical I-beam posts are already installed in numerous places in which they comprise the support for barriers which utilize horizontally extending steel rail type sections secured to these posts. In this regard, the inventive concept includes the removal of the horizontally extending guard rails and utilization of the vertical posts as the basis for installation of the remainder of the barrier structure.

Secured to the posts are a number of form plates having a pair of downwardly and outwardly diverging legs and a pair of upwardly divergingly extending arms, which plates have ears turned out of them used to secure the plates to the vertically positioned spaced apart I-beams previously referred to. With the plates so secured, reinforcing rods are extended through alined apertures in a number of consecutively spaced plates, and side panels are secured to tabs on the side edges of the plates and interfittingly engaged with the bottoms of the plates legs and the tops of the plates arms so that the side panels are retained in a predetermined position with respect to the upstanding plates. The side panels are made in lengths which are end connected together with splicing joints.

With the structure just described in an assembled condition, concrete is poured down through the open top of the structure so as to completely fill the inside faces of the side panels which act as a form for the concrete being poured, and which side panels are bonded to the concrete and remain as a permanent part of the barrier structure. The reinforcing rod is cast integrally within the concrete because the rods are contained within the confines of the side panels. When the concrete has been filled to the top, a capping piece is pressed down into the concrete and interlocks with side panels. The form plates may be made of stamped metal or molded plastic, and the side panels, splicing joints and capping pieces are preferably made of extruded or molded plastic which may be fluorescent, have a reflecting outer surface or have reflecting strips secured to the outer surface. Expansion joints between adjacent endwise alined sections of poured concrete are provided by bituminous impregnated fibrous spacers.

A primary object of the invention is to provide a novel barrier structure of the in-situ poured concrete type utilizing lightweight form structures which become integral parts of the finished barrier structure.

Another object of the invention is to provide a novel barrier structure as aforesaid in which the form structures are relatively inexpensive mass-produced parts.

A further object of the invention is to provide a novel barrier structure as aforesaid in which the form parts are attachable to certain types of pre-existing barrier structures which provides substantial economies in materials and labor.

Yet another object of the invention is to provide a novel barrier structure as aforesaid which eliminates the need for heavy, bulky and expensive forms which require maintenance, storage and replacement.

Still a further object of the invention is to provide a novel barrier structure as aforesaid which includes side panels and capping pieces secured to shaped form plates which are in turn secured to spaced apart vertical posts embedded in the underlying surface, the plates having reinforcing rods extending therethrough with concrete filled within the side panels and encapsulating the form plates and reinforcing rods.

The foregoing and other objects of the invention will become clear from an examination of the following specification in conjunction with the appended drawings, wherein.

In the several figures, like elements are denoted by like reference characters.

Figures 1, 2, 9, 10:
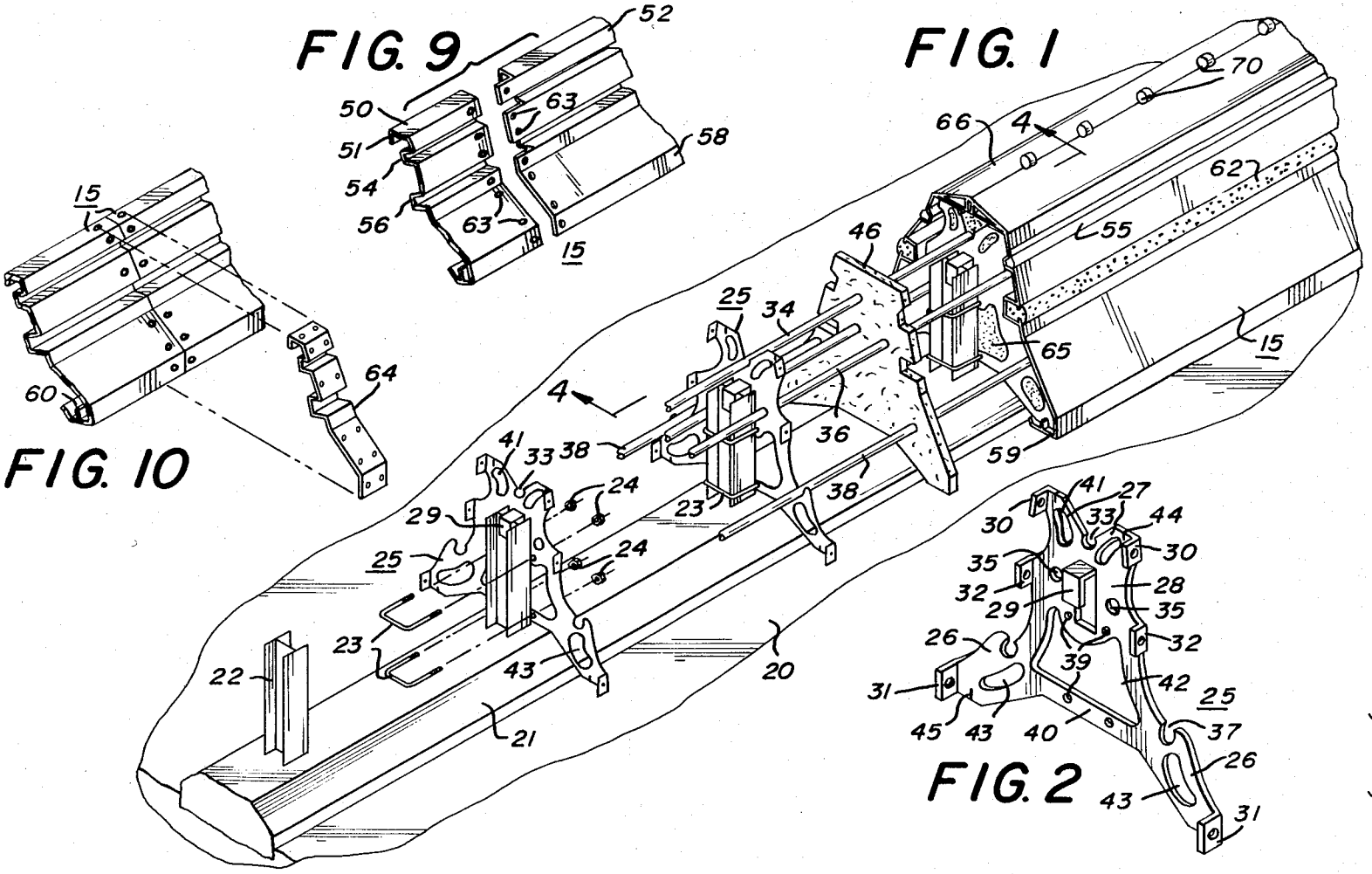
FIG. 1 is a fragmentary, partly exploded perspective view of a barrier structure according to the invention.
FIG. 2 is a perspective view of a medial barrier form plate.
FIG. 9 is a fragmentary perspective view of one form of side panels splice joint.
FIG. 10 is a fragmentary perspective view of a second form of side panels splice joint.

Referring now to the drawings, and first to FIGS. 1 through 5, there is seen a road bed 20 in which has been poured a longitudinally extending concrete strip 21 in which is anchored a plurality of spaced apart vertically extending I-beam posts 22. Secured to each of the I-beam posts 22 by a pair of U-bolts 23 and nuts 24 is a form plate 25, the details of which are most clearly seen in the showing of FIG. 2.

Figure 5:
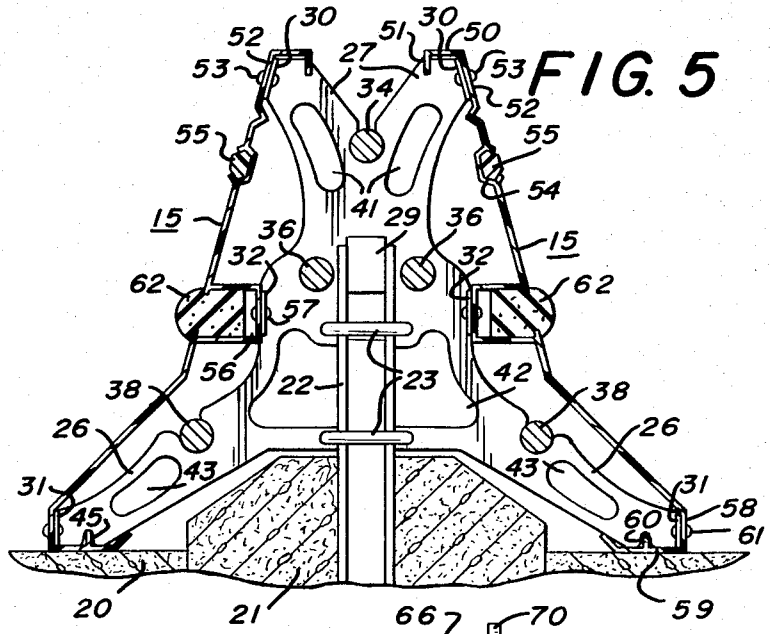
FIG. 5 is a cross-sectional view through an assembled barrier structure according to the invention prior to the pouring of concrete thereinto.
Figure 4:
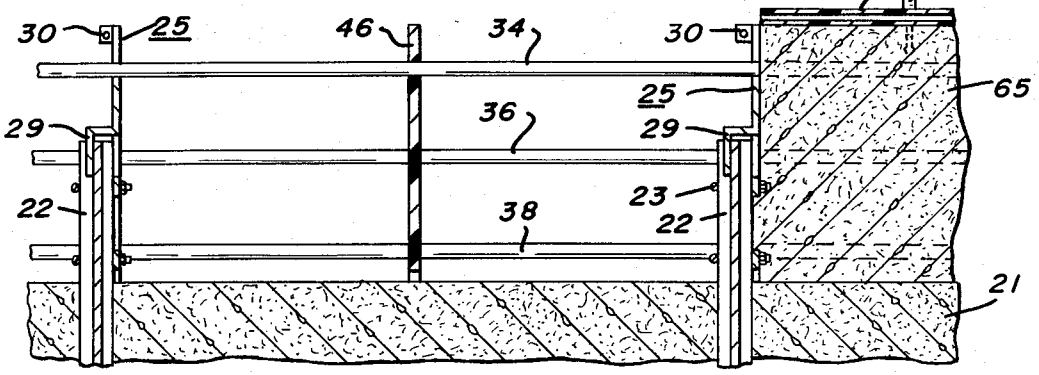
FIG. 4 is a vertical longitudinal section through the barrier structure of FIG. 1 as would be seen when viewed along line 4—4 thereof.
Figure 6:
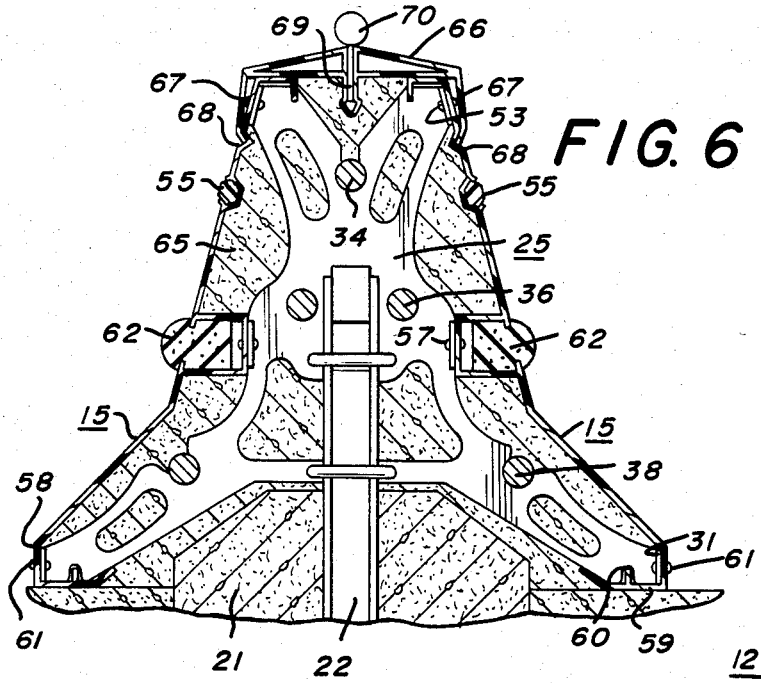
FIG. 6 is the same view as FIG. 5 but after the pouring of concrete and installation of a capping piece.

The form plate 25 is of a truncated generally triangular shape having a pair of downwardly diverging legs 26 and upwardly diverging arms 27 extending from a main body portion 28. Turned outward from the main body portion 28 is a down turned tab 29, which as best seen in the showing of FIGS. 1, 4 and 5 clips downward over the web of the I-beam posts 22 to hold the plane of the form plate 25 flatwise against the edges of the legs of the I-beam posts 22. Alternatively, the tab 29 may be turned out but now down until actual installation, whereby differences in I-beam legs dimensions may be accomodated for. Turned forward from the upper ends of the arms 27 are a pair of apertured upper tabs 30, a similar pair of apertured lower tabs 31 extending from the bottom ends of legs 26, and a pair of apertured medial tabs 32 extending from the main body portion 28 in the same direction as the tabs 30 and 31.

Formed or punched in the plate 25 at the juncture of the arms 27 is a reinforcing rod receiving aperture 33 into which is seatable a reinforcing rod such as that shown at 34 in FIG. 1. Punched or otherwise formed in the main body portion 28 of the form plate 25 are a pair of laterally spaced apart rod receiving apertures 35 through which are disposable reinforcing rods as shown at 36 in FIGS. 1 and 5. Additionally punched or formed in the upper edges of the legs 26 are rod receiving apertures 37 within which are disposable reinforcing rods 38, as also best seen in FIGS. 1 and 5.

The main body portion 28 of the plate 25 is provided with a pair of U-bolt holes 39 as is the tie strap 40 which ties together the midregions of the legs 26, these holes being adapted to receive therethrough the threaded ends of the U-bolts 23, as previously described. The form plate 25 is also apertured in the arms and legs regions as shown at 41, 42 and 43 so that concrete may move through the apertures to lock the form plate tightly to the posts 22 and within the barrier, eliminating void spaces. Finally, the tops of the arms 27 and the bottoms of the legs 26 are provided respectively with vertically extending slots 44 and 45 which receive and hold ribs or flanges of the side panels, as will be subsequently described. A finishing form plate at the end of a barrier would be made without the apertures 41, 42 and 43, or, alternatively, a spacer 46 as shown in FIG. 3 may be placed between a form plate 25 and a post 22 to block off concrete flow through the apertures 41, 42 and 43.

Figure 3:
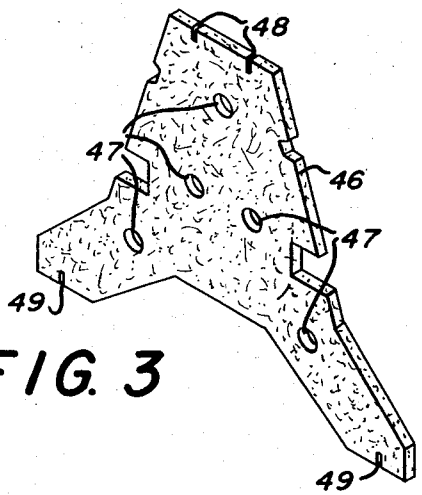
FIG. 3 is a perspective view of a medial barrier spacer.

As best seen in FIGS. 1,3 and 4, concrete expansion spacers 46 are disposed at longitudinal intervals within the barrier, and separate endwise aligned sections of the concrete barrier from one another to provide the normal function of a resilient spacer to accomodate longitudinal extensions of the concrete sections during weather of elevated temperature. The spacers 46 may be made of any suitable material such as deformable plastic or bituminous impregnated fibrous material. The spacers 46 are of similar shape to the form plates 25 and are the same in exterior configuration as the cross section of the poured concrete barrier. They are provided with a plurality of holes 47 to accomodate the reinforcing rods 34, 36 and 38, and are also provided with upper and lower slots 48 and 49 respectively which correspond in position and function to the upper slots 44 and lower slots 45 of the form plates 25.

As best seen from FIGS. 1, 5, 6 and 9, the side panels 15 of extruded or molded plastic are configured to interfit with and be secured to the form plates 25. The side panel 15 has a top surface 50 from which depends an upper flange 51 which fits downward into the upper slot 44 in the arm 27 of the form plate 25. With the upper flange 51 of the side panel seated in the slot 44 of the form plate, the upper side surface 52 of the side panel lies flatwise alongside of the apertured upper tabs 30 of the form plates 25 and is securable thereto by means of rivets 53, as best seen in the showing of FIG. 5. The side panels are convoluted throughout their remaining downward extent to provide a generally concave shape which conforms to the side edge surface of the expansion spacers 46 shown in FIG. 3.

This configuration provides a recess 54 into which is snap-fittable a longitudinally extending fluorescent or day-glow reflector strip 55, but which also functions to rigidify the upper portion of the side panel against outward deformation due to pressure of the uncured concrete when the latter is poured into the form created by the side panels when they are secured to the form plates. A second recess 56 is formed in the side panel at the location of the form plate medial tabs 32, and as also seen in FIG. 5, the side panels are secured to the form plates at this point by rivets 57. From the recess 56 the side panel extends downward and outward to a bottom side surface 58, where it turns inward beneath the bottom edge of the form plate leg 26 as a side panel bottom surface 59, and then turns angularly upward and inward to engage the upwardly diverging lower edge of the form plate leg 26. Formed integrally with and extending upward from the upper surface of the side panel bottom surface 59 is a rib or flange 60 which projects upward into the lower slot 45 formed in the bottom of the form plate leg 26. The side panel bottom side surface 58 is riveted as at 61 to the apertured lower tab 31 formed at the bottom of the form plate leg 26. A resilient bumper strip 62 is snap-fittable into the side panel recess 56.

FIG. 9 illustrates one manner of securing adjacent side panels endwise to one another by cutting off the end portions of the inwardly projecting parts of the side panels and leaving only the side faces intact. This then permits abutment of endwise aligned portions of the side panels, namely the portions 50, 51, 59 and 60, and the recessed regions 54 and 56, with an outer surface overlap. The overlap may then be drilled, either on site or as a manufacturing step, as shown at 63 in FIG. 9, and the overlapped panel ends may then be secured together by rivets or any other convenient means. Alternatively, as shown in FIG. 10, a molded joint cover piece or batten piece 64 may be utilized to cover and interfit with the abutted ends of a pair of adjacent side panels, with the joint cover or batten piece 64 being then fixedly secured to each of the side panels by means of rivets or other desired securements.

To install the medial barrier according to the invention, the first step is to provide the concrete strip 21 and I-beam posts 22 set into the roadbed. This may either be a new installation or may be an existing installation as previously described in which this structure remains after the conventional steel guard rail side structures have been disassembled. Melted tar is most suitably then sprayed or applied to the roadbed alongside the strip 21 to provide a good seal along the bottom of the barrier side panels to be installed, although this step is not absolutely required. The form plates 25 are next installed on the I-beam posts 22 although the U-bolts 23 are not pulled up completely tight at this point. The reinforcing rods 34, 36 and 38 are next installed in the form plates 25, with expansion spacers 46 being inserted at appropriate longitudinal locations. The side panels are next installed by slipping them under the legs 26 of the form plates so that the ribs 60 snap into the form plate lower slots 45, and so that the upper flange 51 snaps downward into the form plate upper slots 44. The form plate 25 is then pressed downward so that the side panel bottom surface 59 seats firmly down against the roadbed, and the U-bolt nuts 24 are then drawn in tightly to anchor the form plate in its downwardly seated position. Access to the nuts 24 is had through the open top of the structure between the side panels.

This process is continued longitudinally as far as is desired to provide a good pouring section. In fact this work can be carried on continuously as long as there are posts 22 available for securements. Concrete is then poured down through the open top of the structure between the side panels so that it completely fills up the hollow interior to the top surfaces 50 of the side panels 15, the concrete fill being shown in FIGS. 1, 4 and 6 as 65. A capping strip 66 is then snapped downward over the longitudinally extending upper surface of the barrier so that its depending side flanges 67 snap into recesses 68 formed in the upper side edges of the side panels, and with a depending anchor rib 69 projected downward into the concrete 65. The shelved shoulder shape of the anchor rib 69 causes the capping strip 66 to be fixedly anchored in place when the concrete 65 cures.

Reflectors 70 may if desired be snap-fitted into the top of the capping strip 6. When the concrete 65 has completely cured, the barrier is completed and there is nothing to be removed and carted away for storage. With the poured concrete contained within the side panels and capping strip, the barrier is weather tight as soon as it has been poured, and no additional steps need be taken to protect the barrier while it is curing. Additionally, the concrete cures at a relatively slow and predictable rate so that maximum strength is achievable.

Figure 7:
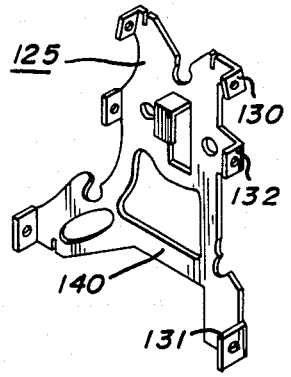
FIG. 7 is a perspective view of a form plate similar to that of FIG. 2 but intended for use as a roadside guard barrier.
Figure 8:
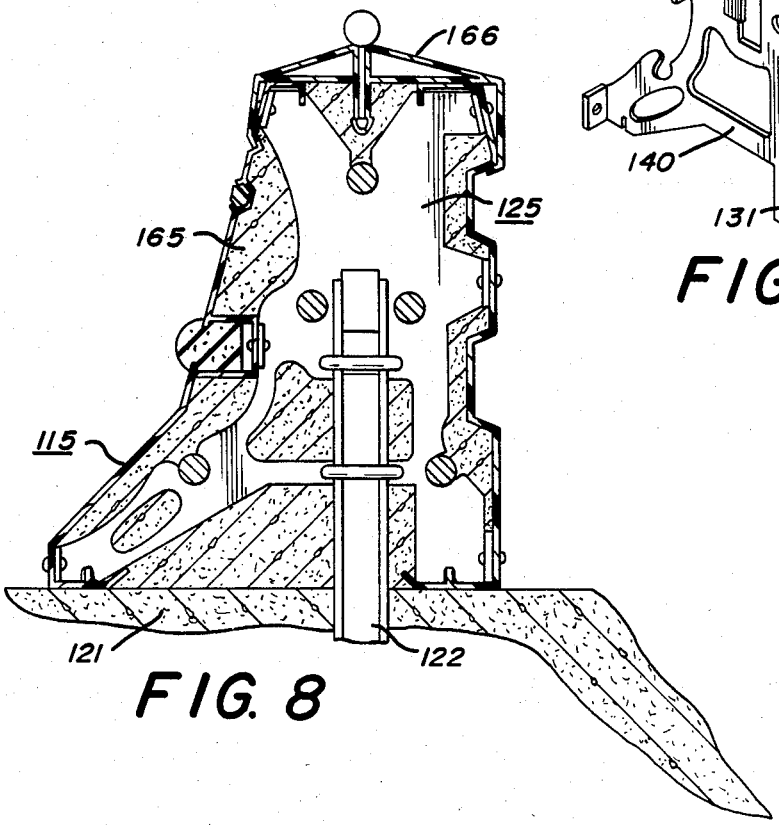
FIG. 8 is a cross-sectional view of the same kind as shown in FIG. 6 but utilizing the form plate of FIG. 7.

FIG. 7 illustrates a form plate 125 which is functionally exactly the same as form plate 25, the only difference being that it has a somewhat different shape because it is utilized as a roadside guard rail structure. As best seen in the showing of FIG. 8, the structure is in all ways similar to that shown in FIG. 6 except for the right side of the barrier which is substantially vertical. This shape is more conservative of materials since it is volumetrically smaller. The elements shown in FIGS. 7 and 8 are numbered correspondingly to the comparable parts in FIGS. 2 and 6 excepting for the addition of the number 1 prefixed to the reference characters.

Having now described the invention in connection with particularly illustrated embodiments thereof, modifications and variations of the invention may now occur from time to time to those persons normally skilled in the art without departing from the essential scope or spirit of the invention, and accordingly it is intended to claim the same broadly as well as specifically as indicated by the appended claims.

What is claimed to be new and useful is:

1. A hollow barrier structure assembly for receiving into its hollow interior a solidifiable plastic material which when solidified forms a monolithic barrier structure integral with the hollow barrier structure assembly, said hollow barrier structure assembly comprising in combination, (a) a plurality of form plates having spaced apart sides and the major plane of each of which form plates is oriented transversely to the running length of the barrier assembly, said form plates being spaced apart at intervals along the length of the barrier assembly and each having a cross-sectional area less than the cross sectional area of the barrier structure assembly interior, and including at least one aperture therethrough through which solidifiable, plastic material is penetrable, (b) a pair of spaced apart pre-formed thin walled opposite side panels of predetermined shape and length fixedly securable to said form plates and extending longitudinally along the sides of said form plates to form a substantially dimensionally stable assembly, said side panels having upper edges and lower edges with said lower edges being substantially seatable against the underlying surface over which said barrier structure assembly is supported, (c) means for fixedly intersecuring said form plates and side panels, (d) reinforcing rods extending longitudinally within said barrier structure transversely to and through the major plane of said form plates, and means for mechanically interengaging said reinforcing rods with said form plates, whereby, said form plates and side panels when intersecured as aforesaid form a hollow barrier structure into which solidifiable plastic material may be poured and retained to form a continuous plastic mass between said side panels around said reinforcing rods and on both sides of said form plates, which mass when solidified locks said form plates and reinforcing rods therewithin between said side panels.

2. A hollow barrier structure assembly as defined in claim 1 wherein, (a) the general shape of each of said form plates is that of a truncated triangle with concave sides, (b) said form plates each includes at least one aperture therethrough through which solidifiable plastic material is penetrable to form a continuous plastic mass on both sides of the form plate, which mass when solidified locks said form plate therewithin, and further including, (c) reinforcing rods extending longitudinally within said barrier structure transversely to and through the major plane of said form plates, and means for mechanically interengaging said reinforcing rods with said form plates.

3. A hollow barrier structure assembly as defined in claim 1 wherein the general shape of each of said form plates is that of a truncated triangle with concave sides, and wherein said side panels assume a concave shape when secured to said form plates.

4. A hollow barrier structure assembly as defined in claim 1 further including anchor means for fixedly securing said form plates to the underlying surface over which said form plates are disposed prior to pouring solidifiable plastic material into said hollow barrier structure, said anchor means comprising posts anchored to and extending vertically upward from the said underlying surface, and means for securing said form plates to said posts.

5. A hollow barrier structure assembly as defined in claim 1 wherein said form plates each includes at least one aperture therethrough through which solidifiable plastic material is penetrable to form a continuous plastic mass on both sides of each of said form plates, which mass when solidified locks said form plate therewithin.

6. A hollow barrier structure assembly as defined in claim 1 further including reinforcing rods extending longitudinally within said barrier structure transversely to and through the major plane of said form plates, and means for mechanically interengaging said reinforcing rods with said form plates.

7. A hollow barrier structure assembly as defined in claim 1 wherein the major plane of each of said form plates is oriented substantially orthogonally to the running length of said barrier assembly.

8. A hollow barrier structure assembly as defined in claim 1 or 2 wherein said means for fixedly intersecuring said form plates and said side panels comprises anchor points spaced vertically on said form plates and anchor means for fixing overlying points of said side panels to said form plates anchor points.

9. A hollow barrier structure assembly as defined in claim 1 wherein the ends of endwise positioned longitudinally extending ones of said panels are fixedly intersecured to form a continuous side panel, said intersecurement comprising the abutted ends of an adjacent pair of side panels and a separate joint cover or batten covering the joint between and fixedly secured to the adjacent ends of both side panels.

10. A hollow barrier structure assembly as defined in claim 1 wherein the ends of longitudinally extending ones of said side panels are fixedly intersecured to form a continuous side panel, said intersecurement comprising abutted and overlapped portions of the proximate ends of adjacent side panels with the overlapped portions being secured together.

11. A hollow barrier structure assembly as defined in claim 1 or 2 wherein the upper longitudinally extending edges of said side panels are substantially to one another and spaced apart a sufficient distance to permit top feeding of a solidifiable plastic material into the hollow interior of said barrier structure.

12. A hollow barrier structure assembly as defined in claim 1 wherein the upper longitudinally extending edges of said side panels are substantially parallel to one another and spaced apart a sufficient distance to permit top feeding of a solidifiable plastic material into the hollow interior of said barrier structure, and a top capping panel bridging and covering the space between the upper longitudinally extending edges of said side panels, and means for holding together said top capping panel and side panels as a unit.

13. A hollow barrier structure assembly as defined in claim 1 further including a generally planar spacer therewithin of the same cross-sectional shape as said barrier structure and positioned transversely to the length of the barrier structure between said opposite side panels, said spacer being compressible under load to act as an expansion joint for solidified plastic material occupying the space on opposite faces of said spacer.

14. A hollow barrier structure assembly as defined in claims 1 wherein said form plates each comprise a main body portion from which upwardly extend a pair of diverging arms and from which downwardly diverge a pair of legs, the upper ends of said arms and the lower ends of said legs including integral latching means interfittable with complementally formed integral latching means at the top and bottom of said side panels, and wherein said side panels include complementally formed integral latching means as aforesaid, whereby said side panels are latchable to said form plates.

15. A hollow barrier structure as defined in claim 4 wherein said means for fixedly securing at least one of said form plates to the underlying surface comprises a post anchored to and extending vertically upward from the said underlying surface, and means for securing said at least one form plate to said post.

16. A barrier structure as defined in claim 1 further including a mass of solidified plastic material completely filling the spaces between and around said form plates and reinforcing rods and between said opposite side panels, said form plates and reinforcing rods being locked within said solidified plastic material between said side panels by reason of their smaller cross-sectional area.

17. A barrier structure as defined in claim 16 wherein, (a) the general shape of each of said form plates is that of a truncated triangle with concave sides, (b) said form plates each includes at least one aperture therethrough through which solidified plastic material is disposed to form a continuous plastic mass on both sides of the form plate which locks said form plate therewith, and further including, (c) reinforcing rods extending longitudinally within said barrier structure transversely to and through the major plane of said form plates, and means mechanically interengaging said reinforcing rods with said form plates.

18. A barrier structure as defined in claim 16 wherein the shape of each of said form plates is generally that of a truncated triangle with concave sides.

19. A barrier structure as defined in claim 16 or 17 further including means for fixedly securing said form plates to the underlying surface over which said form plates are disposed.

20. A barrier structure as defined in claim 16 wherein said form plates each includes at least one aperture therethrough through which solidified plastic material is extended to form a continuous plastic mass on both sides of each of said form plates which locks said form plate therewithin.

21. A barrier structure as defined in claim 16 further including reinforcing rods extending longitudinally within said barrier structure transversely to and through the major plane of each of said form plates, and means mechanically interengaging said reinforcing rods with said form plates.

22. A barrier structure as defined in claim 16 wherein the major plane of each of said form plates is oriented substantially orthogonally to the running length of said barrier assembly.

23. A barrier structure as defined in claim 16 or 17 wherein said means fixedly intersecuring said form plates and said side panels comprises anchor points spaced vertically on said form plates and anchor means fixing overlying points of said side panels to said form plates anchor points.

24. A barrier structure as defined in claim 16 or 17 wherein the ends of endwise positioned longitudinally extending ones of said side panels are fixedly intersecured to form a continuous side panel, said intersecurement comprising the abutted ends of an adjacent pair of side panels and a separate joint cover or batten covering the joint between and fixedly secured to the adjacent ends of both side panels.

25. A barrier structure as defined in claim 16 wherein the ends of longitudinally extending ones of said side panels are fixedly intersecured to form a continuous side panel, said intersecurement comprising abutted and overlapped portions of the proximate ends of adjacent side panels with the overlapped portions being secured together.

26. A barrier structure as defined in claim 16 or 17 wherein the upper longitudinally extending edges of said side panels are substantially parallel to one another and spaced apart.

27. A barrier structure as defined in claim 16 or 17 wherein the upper longitudinally extending edges of said side panels are substantially parallel to one another and spaced apart, and a top capping panel bridges and covers the space between the upper longitudinally extending edges of said side panels, and means holding together said top capping panel and side panels as a unit.

28. A barrier structure as defined in claim 16 further including at least one generally planer spacer therewithin of the same cross-sectional shape as said barrier structure and positioned transversely to the length of the barrier structure, said spacer being compressible under load to act as an expansion joint for solidified plastic material occupying the space on opposite faces of said spacer.

29. A barrier structure as defined in claims 16 or 17 wherein said form plates each comprise a main body portion from which upwardly extend a pair of diverging arms and from which downwardly diverge a pair of legs, the upper ends of said arms and the lower ends of said legs including latching means interfitted with complementally formed latching means at the top and bottom of said side panels, and wherein said side panels include complementally formed latching means as aforesaid, whereby said side panels are latched to said form plates.

30. A barrier structure as set forth in claim 1 or 16 wherein said side panels are formed with projections extending from the side thereof which faces inward toward said form plates.

31. A barrier structure as defined in claim 19 wherein said means for fixedly securing at least one of said form plates to the underlying surface comprises a post anchored to and extending vertically upward from the said underlying surface, and means securing said at least one form plate to said post.

* * * * *